US005520389A

United States Patent [19]

Furrow

[11] Patent Number: 5,520,389

[45] Date of Patent: May 28, 1996

[54] GOLF CLUB BALL RETRIEVAL DEVICE

[76] Inventor: Brady M. Furrow, 4243 Mountain View Rd., Roanoke, Va. 24017

[21] Appl. No.: 490,663

[22] Filed: Jun. 15, 1995

[51] Int. Cl.[6] ..... A63B 53/00

[52] U.S. Cl. ..... 473/286; 294/19.2

[58] Field of Search ..... 273/162 E, 32 F; 294/19.2

[56] References Cited

U.S. PATENT DOCUMENTS 3,712,658 1/1973 Yaresh ..... 273/162 E

FOREIGN PATENT DOCUMENTS 2128484 5/1984 United Kingdom ..... 273/162 E

*Primary Examiner*—George J. Marlo

[57] ABSTRACT

A golf ball retrieval device adapted to be removeably secured to the handle end of a golf club comprising:

a golf club handle receiving member, said receiving member being hollow and having a circular cross-section throughout the length thereof, said circular cross-section decreasing in diameter from an exterior end thereof to an interior end thereof to form a hollow truncated conical shape adapted to receive golf club handles of varying diameters therein and to frictionally engage such handles by contact with the internal surfaces of said hollow truncated conical shape;

an end plate radially disposed across the interior end of said truncated conical shape to prevent entrance or egress therefrom; and, a thin annular member affixed to said end plate at one edge thereof, said annular member extending from said plate and from the truncated conical shape to which it is affixed.

3 Claims, 4 Drawing Sheets

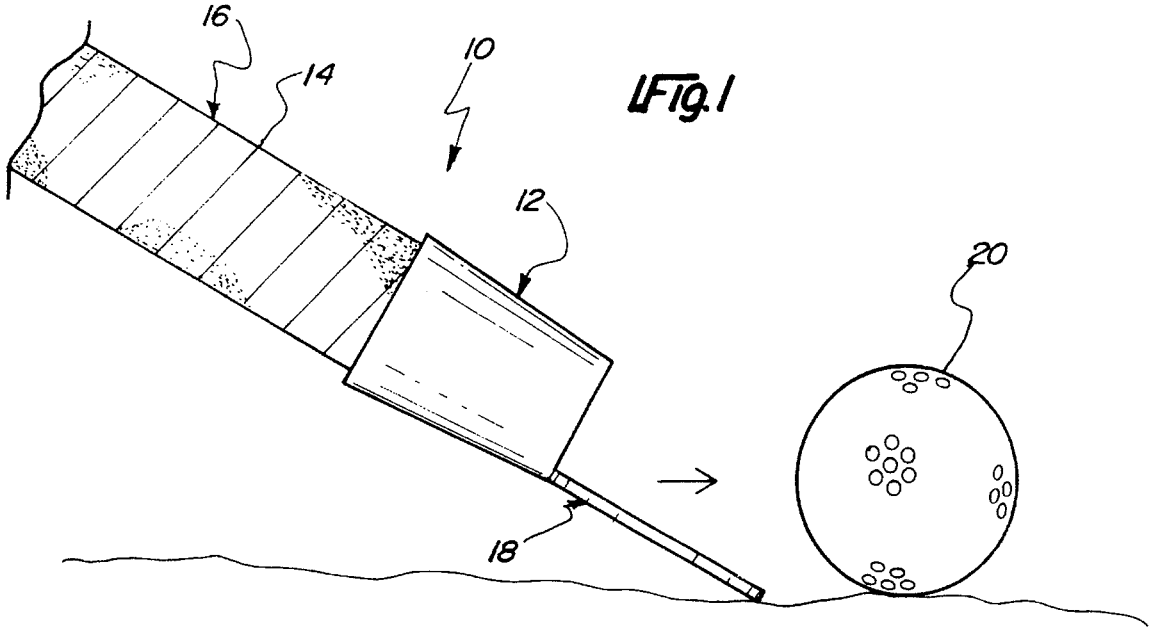
Fig. 1
Fig. 2
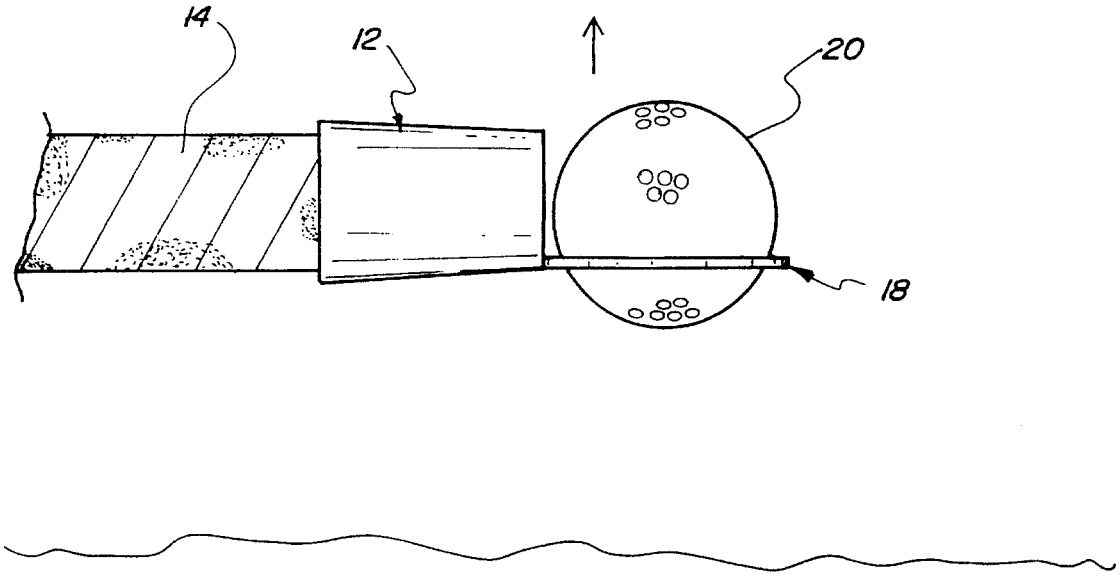

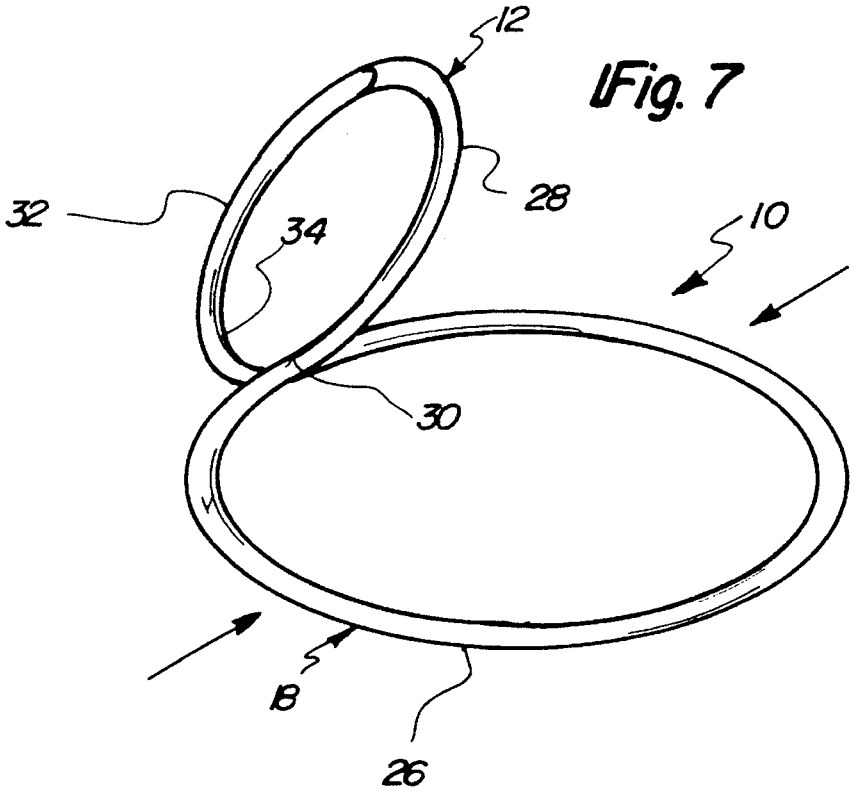
Fig. 7
Fig. 8
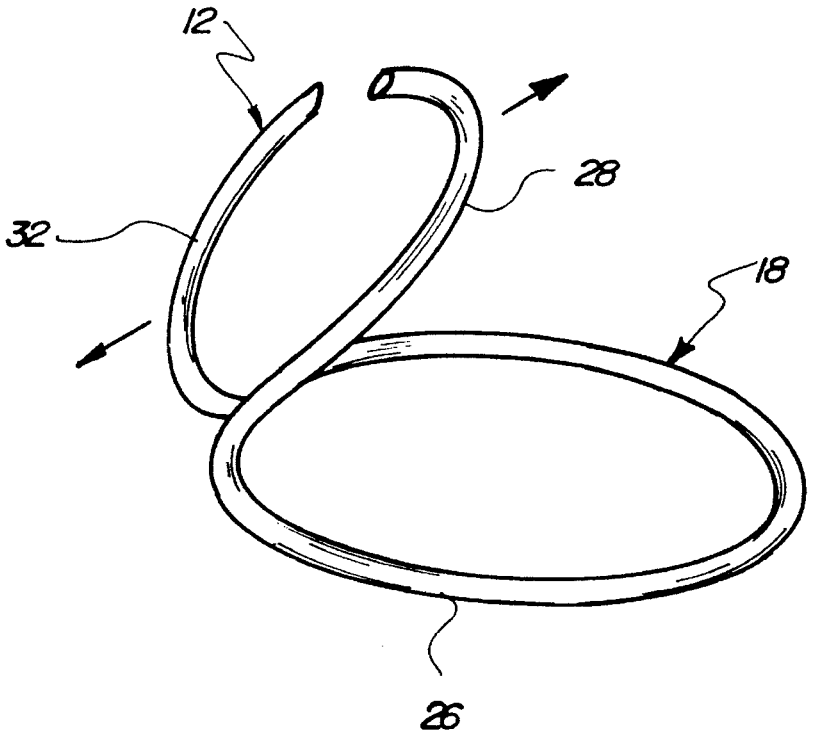

GOLF CLUB BALL RETRIEVAL DEVICE

BACKGROUND OF THE INVENTION

1. Field of the Invention

The present invention relates to golf ball handling structures and more particularly pertains to a golf club ball retrieval device for engaging and facilitating extraction of a golf ball from a remote area.

2. Description of the Prior Art

The use of golf ball handling structures is known in the prior art. More specifically, golf ball handling structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf ball handling structures include U.S. Pat. No. 5,190,288; U.S. Pat. No. 5,188,409; U.S. Pat. No. 5,269,525; U.S. Pat. No. 4,687,204; U.S. Pat. No. 4,580,784; and U.S. Pat. No. 3,632,112.

While these devices fulfill their respective, particular objectives and requirements, the aforementioned patents do not disclose a golf club ball retrieval device for engaging and facilitating extraction of a golf ball from a remote area which includes a mounting assembly for securing to a handle grip of a golf club, and an engaging assembly extending from the mounting assembly for engaging a golf ball to permit extraction of the ball from a remote area.

In these respects, the golf club ball retrieval device according to the present invention substantially departs from the conventional concepts and designs of the prior art, and in so doing provides an apparatus primarily developed for the purpose of engaging and facilitating extraction of a golf ball from a remote area.

SUMMARY OF THE INVENTION

In view of the foregoing disadvantages inherent in the known types of golf ball handling structures now present in the prior art, the present invention provides a new golf club ball retrieval device construction wherein the same can be utilized for engaging and facilitating extraction of a golf ball from a remote area. As such, the general purpose of the present invention, which will be described subsequently in greater detail, is to provide a new golf club ball retrieval device apparatus and method which has many of the advantages of the golf ball handling structures mentioned heretofore and many novel features that result in a golf club ball retrieval device which is not anticipated, rendered obvious, suggested, or even implied by any of the prior art golf ball handling structures, either alone or in any combination thereof.

To attain this, the present invention generally comprises a retrieval device for engaging and facilitating extraction of a golf ball from a remote area. The inventive device includes a mounting assembly for securing to a handle grip of a golf club. An engaging assembly extends from the mounting assembly for engaging a golf ball to permit extraction of the ball from a remote area.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club ball retrieval device apparatus and method which has many of the advantages of the golf ball handling structures mentioned heretofore and many novel features that result in a golf club ball retrieval device which is not anticipated, rendered obvious, suggested, or even implied by any of the prior art golf ball handling structures, either alone or in any combination thereof.

It is another object of the present invention to provide a new golf club ball retrieval device which may be easily and efficiently manufactured and marketed.

It is a further object of the present invention to provide a new golf club ball retrieval device which is of a durable and reliable construction.

An even further object of the present invention is to provide a new golf club ball retrieval device which is susceptible of a low cost of manufacture with regard to both materials and labor, and which accordingly is then susceptible of low prices of sale to the consuming public, thereby making such golf club ball retrieval devices economically available to the buying public.

Still yet another object of the present invention is to provide a new golf club ball retrieval device which provides in the apparatuses and methods of the prior art some of the advantages thereof, while simultaneously overcoming some of the disadvantages normally associated therewith.

Still another object of the present invention is to provide a new golf club ball retrieval device for engaging and facilitating extraction of a golf ball from a remote area.

Yet another object of the present invention is to provide a new golf club ball retrieval device which includes a mounting assembly for securing to a handle grip of a golf club, and an engaging assembly extending from the mounting assembly for engaging a golf ball to permit extraction of the ball from a remote area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevation view of a golf club ball retrieval device according to the present invention in use.

FIG. 2 is a further elevation view of the present invention in use.

FIG. 7 is an isometric illustration of the alternative form of the invention, per se.

FIG. 8 is a further isometric illustration of the alternative form of the invention.

DESCRIPTION OF THE PREFERRED EMBODIMENT

Figure 3:
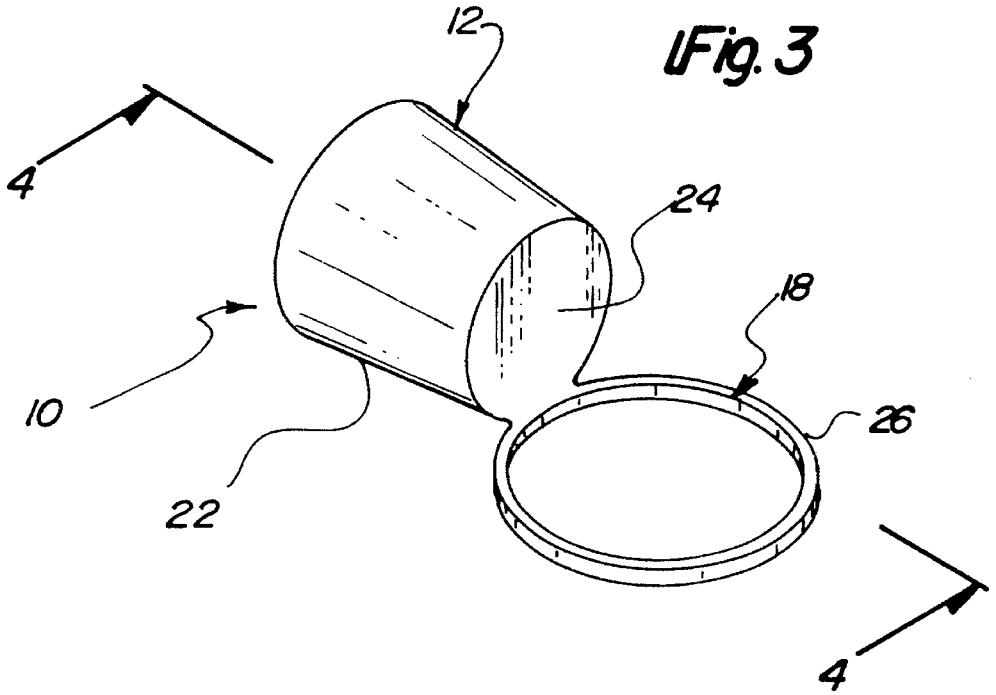
FIG. 3 is an isometric illustration of the invention, per se.

With reference now to the drawings, and in particular to FIGS. 1–8 thereof, a new golf club ball retrieval device embodying the principles and concepts of the present invention and generally designated by the reference numeral 10 will be described.

More specifically, it will be noted that the golf club ball retrieval device 10 comprises a mounting means 12 for securing to a handle grip 14 of a golf club 16, as shown in FIG. 1 of the drawings. An engaging means 18 extends from the mounting means 12 for circumferentially positioning about a portion of a golf ball 20 to permit extraction of the golf ball from a remote area such as within a pond or the like, as shown in FIGS. 1 and 2 of the drawings.

Figure 4:
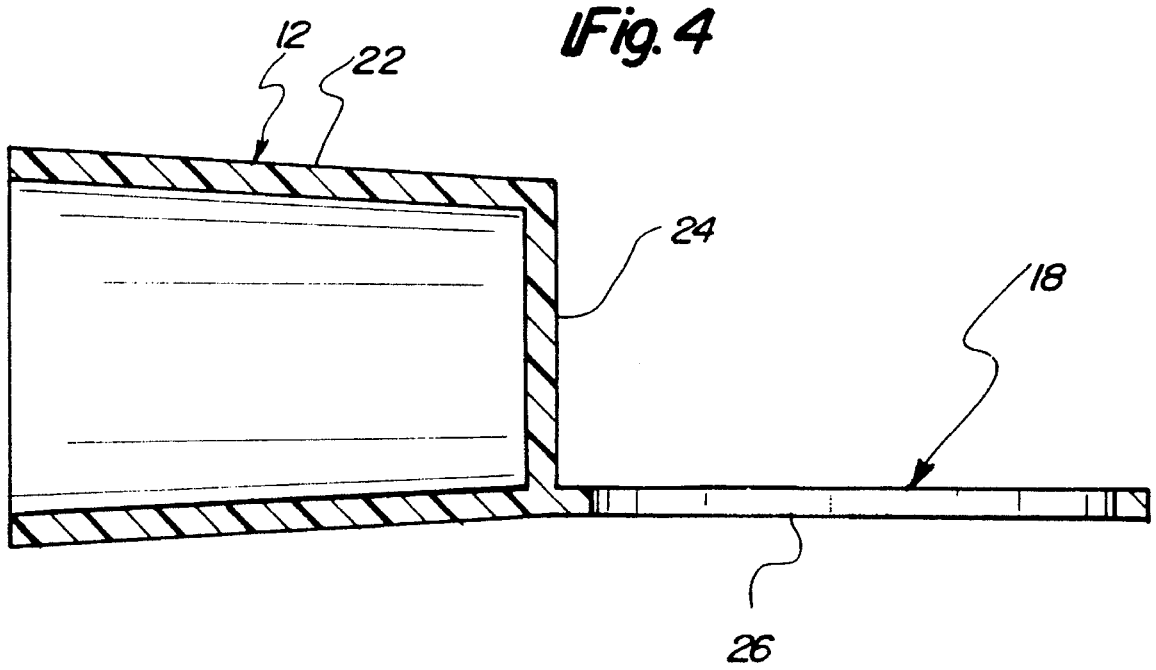
FIG. 4 is a cross-sectional view taken along line 4—4 of FIG. 3.

Referring now to FIGS. 3 and 4 wherein the present invention 10 is illustrated in detail, it can be shown that the mounting means 12 of the present invention 10 preferably comprises a truncated conical sidewall 22 having an open end of a first diameter and tapering to a closed end of a second diameter, wherein the first diameter is substantially greater than the second diameter. An end plate 24 extends transversely across the truncated conical sidewall 22 so as to form the closed end thereof. By this structure, a handle grip 14 can be inserted into the truncated conical sidewall 22 so as to create a frictional engagement between an interior surface of the truncated conical sidewall and an exterior surface of the handle grip 14 to retain the mounting means 12 relative to the golf club 16 as shown in FIG. 1 of the drawings. The truncated conical sidewall 22, because of its tapered shape, is operable to frictionally engage handle grips 14 of varying diameters.

With continuing reference to FIGS. 3 and 4, it can be shown that the engaging means 18 of the present invention 10 preferably comprises an open annular member 26 integrally or otherwise fixedly secured to the mounting means 12. Preferably, the open annular member 26 is secured to the end plate 24 and positioned in contiguous communication with an outer peripheral edge of the end plate and the truncated conical sidewall 22. Such positioning of the engaging means 18 relative to the mounting means 12 permits a flat positioning of the engaging means 18 along a bottom surface of a pond or like remote area so as to permit positioning of the engaging means underneath a golf ball 20 during engaging and extraction thereof.

Figure 5:
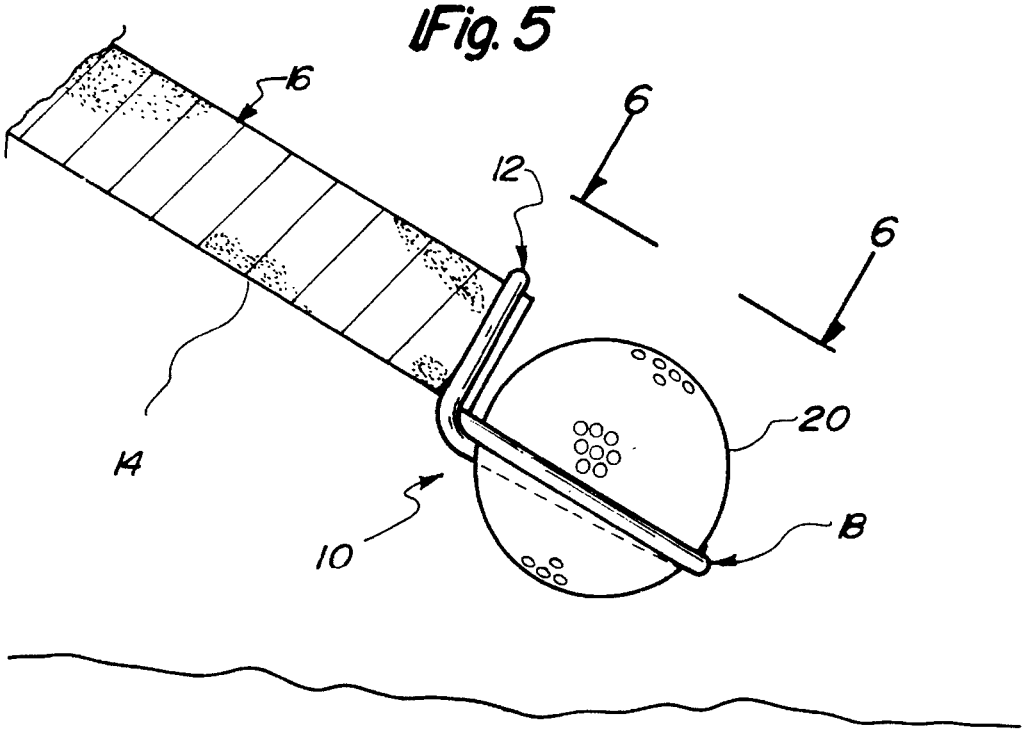
FIG. 5 is an elevation view of an alternative form of the present invention in use.
Figure 6:
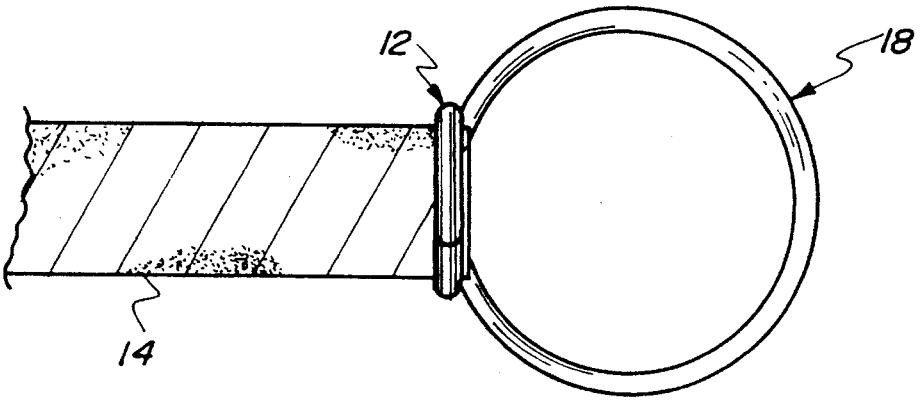
FIG. 6 is a top plan view of the alternative form of the invention taken from line 6—6 of FIG. 5.

Referring now to FIGS. 5 through 8 wherein an alternative form of the present invention 10 is illustrated in detail, it can be shown that the mounting means 12 may alternatively comprise a first arcuate member 28 coupled to a first free end of the open annular member 26 by a first integral bend 30 extending therebetween. Similarly, a second arcuate member 32 is coupled to a second free end of the open annular member 26 by a second integral bend 34. The arcuate members 28 and 32 reside within a first plane oriented substantially orthogonally relative to a second plane containing the open annular member 26. The arcuate members 28 and 32 extend from the respective integral bends 30 and 34 to terminate in facing free ends which are normally abuttingly engaged with one another. The first and second ends of the open annular member 26 overlap one another such that the application of a compressive force to the open annular member 26 as indicated by the arrows in FIG. 7 will effect separation of the arcuate members 28 and 32 in the direction indicated by the arrows within FIG. 8 to permit placement of the mounting means 12 over the handle grip 14 of the associated golf club 16 as shown in FIGS. 5 and 6 of the drawings. A releasing of the compressive force applied to the open annular member 26 will permit the annular member to resiliently expand, thereby closing the arcuate members 28 and 32 about the handle grip 14 of the golf club 16. By this structure, the mounting means 12 of the alternative form of the present invention 10 can be easily secured to a desired handle grip 14 of a particular golf club 16. Further, it is contemplated that the arcuate members 28 and 32 can be integrally or otherwise secured together at the free ends thereof such that the application of a compressive force to the open annular member 26 results in an increase in a circumference of the arcuate members 28 and 32, thereby increasing a diameter or distance therebetween.

In use, the golf club ball retrieval device 10 according to the present invention can be easily secured to a handle grip 14 of an associated golf club 16 to permit such golf club to be utilized in the engaging and extraction of a golf ball 20 from a remote area such as within a pond or the like. The present invention 10 can thus be easily separated from the handle grip 14 of the golf club 16 to permit ease of storage and/or transportation of the device 10 during periods of non-use thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf ball retrieval device adapted to be removeably secured to the handle end of a golf club comprising:

a golf club handle receiving member, said receiving member being hollow and having a circular cross-section throughout the length thereof, said circular cross-section decreasing in diameter from an exterior end thereof to an interior end thereof to form a hollow truncated conical shape adapted to receive golf club handles of varying diameters therein and to frictionally engage such handles by contact with the internal surfaces of said hollow truncated conical shape;

an end plate radially disposed across the interior end of said truncated conical shape to prevent entrance or egress therefrom; and, a thin annular member affixed to said end plate at one edge thereof, said annular member extending from said end plate and from the truncated conical shape to which it is affixed.

2. A golf ball retrieval device as in claim 1 wherein said annular member has a hollow central portion adapted to engage and hold a golf ball therein.

3. A golf club having a long tubular shaft, a ball engaging head at one end of said shaft and a gripping handle at the other end of said shaft;

a removable hollow conically shaped member having an entrance end into which such gripping handle extends, the interior surfaces of such hollow conically shaped member frictionally engaging with the exterior surfaces of said handle, said conically shaped member tapering inwardly from said entrance end so as to provide a frictional fit with a variety of handles of varying diameters; and a hollow center, flat, annular ball engaging member affixed to and projecting from the end of said conically shaped member at the end thereof remote from said entrance end.

* * * * *